United States Patent [19]

Clark

[11] Patent Number: 4,792,470

[45] Date of Patent: Dec. 20, 1988

[54] TWISTED BOXBOARD FURNITURE

[76] Inventor: Harold E. Clark, 136 Glenbrook Ct., Hendersonville, N.C. 28739

[21] Appl. No.: 40,615

[22] Filed: Apr. 21, 1987

[51] Int. Cl.[4] ..... A47B 13/00

[52] U.S. Cl. ..... 428/12; 108/161; 428/542.8

[58] Field of Search ..... 446/487, 488; 428/542.8, 12, 152; 229/8; D6/486, 495; 108/150, 161

[56] References Cited

U.S. PATENT DOCUMENTS

| | | | |
|---|---|---|---|
| 204,441 | 6/1878 | Marshall | 428/542.8 X |
| 643,420 | 2/1900 | Miyaji | 229/8 |
| 1,997,022 | 4/1935 | Stalker | 428/542.8 X |
| 3,354,924 | 11/1967 | Birrell et al. | 222/92 X |
| 3,730,818 | 5/1973 | Salinari | 446/487 X |
| 3,751,317 | 8/1973 | Galloway | 108/161 X |
| 3,894,352 | 7/1975 | Hooker | 428/12 X |
| 3,912,156 | 10/1975 | May | 229/8 X |
| 4,025,012 | 5/1977 | Chan et al. | 428/542.2 X |
| 4,033,068 | 7/1977 | Skillman | 446/487 X |
| 4,517,251 | 5/1985 | Mosely | 428/12 X |

FOREIGN PATENT DOCUMENTS

| | | | |
|---|---|---|---|
| 519577 | 4/1940 | United Kingdom | 229/8 |

*Primary Examiner*—Henry F. Epstein

[57] ABSTRACT

In a twisted, free-standing structure having four sides, each with a diagonal crease, and a central region wherein the creases cross, the improvement wherein the central region is reinforced by means chosen from the group consisting of a thermosetting polymeric material and one or more pieces of stiff reinforcing material bent to conform to a crease.

1 Claim, 3 Drawing Sheets

TWISTED BOXBOARD FURNITURE

BACKGROUND OF THE INVENTION

This invention relates to the manufacture of furniture, e.g., stools and tables, using corrugated boxboard.

Birrell et al. U.S. Pat. No. 3,354,924 describes a well-known twisted figure, which twists to zero height, i.e. to total collapse. For this purpose, it must start as a cube, whereas the structures of my invention, as described below, preferably have a height greater than their width so that they cannot collapse entirely to zero height. Birrell's device requires strong walls and would not perform if made of weak material.

The structure described in another patent, Chan et al. U.S. Pat. No. 4,025,012, as stated in column 3, line 43, even if constructed of thin mild steel, can support only 30 lbs.

SUMMARY OF THE INVENTION

The present invention takes full advantage of the intrinsic strength of void-filled sheets such as boxboard and prevents and overcomes sources of mechanical weakness by means of strategically located reinforcement. The invention also provides constructional features which enable such furniture to appear smooth and neat, and which further enable the structure to be conveniently packaged and then easily pulled into shape by means of a novel gluing configuration.

Accordingly, the invention features, in one aspect, in a twisted, free-standing structure having four sides, each with a diagonal crease, and a central region wherein the creases cross, the improvement wherein the central region is reinforced by means chosen from the group consisting of a thermosetting Polymeric material (e.g., an epoxy) and one or more pieces of stiff reinforcing material (e.g., metal), each bent to conform to a crease.

In another aspect, the invention features a flat, collapsed form having four quadrants defined by four vertical creases, three of the quadrants each having a diagonal crese and the fourth having a diagonal cut line, the form having four pairs of facing triangular regions, each defined by a vertical crease, a diagonal crease or cut line, and a diagonal line bisecting a diagonal crease or cut line, each pair of facing triangular regions being glued together.

Other features and advantages of the invention will be apparent from the following description of the preferred embodiment thereof, and from the claim.

DESCRIPTION OF THE PREFERRED EMBODIMENT

The drawings are first described.

STRUCTURE AND CONSTRUCTION

Figure 1:
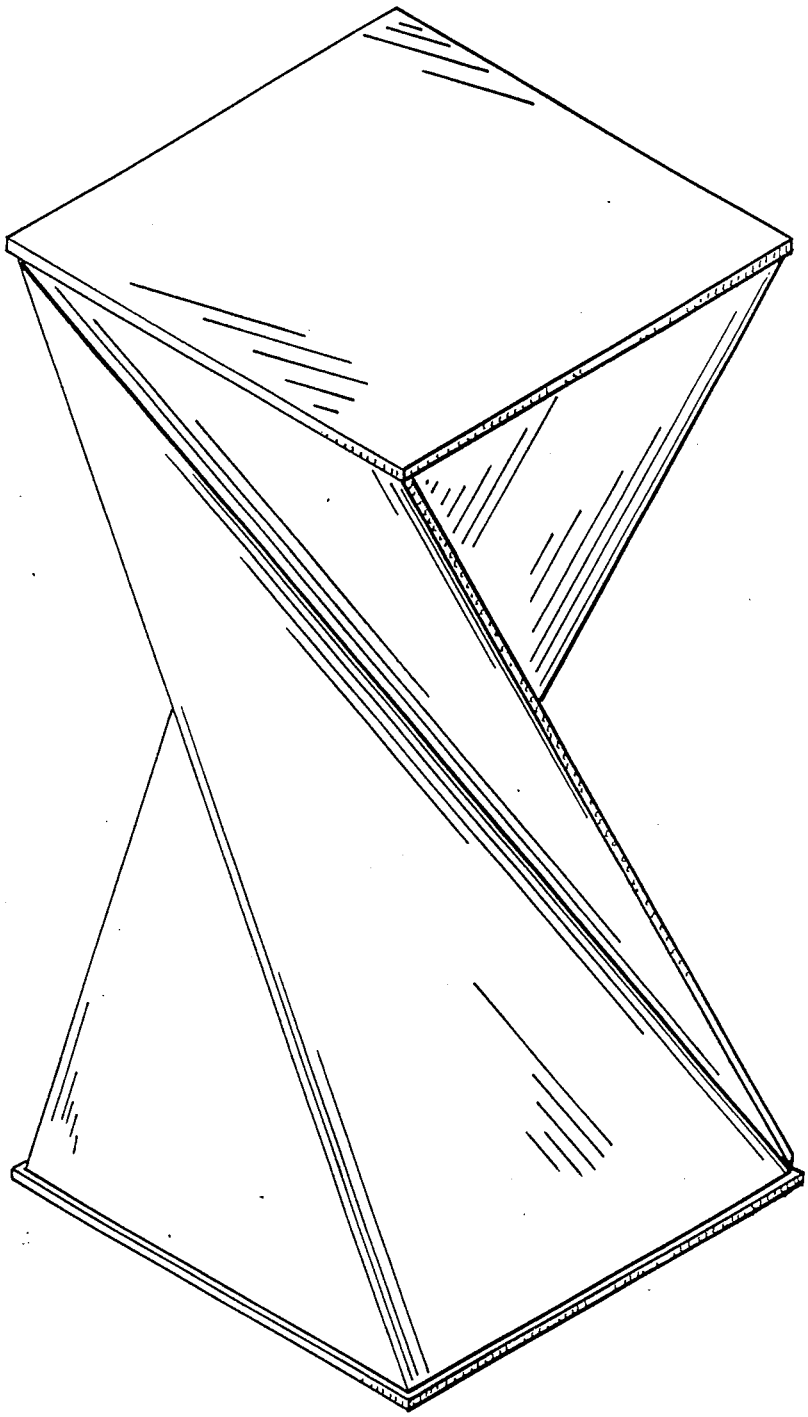
FIG. 1 is a perspective view of a twisted stool of the invention made of boxboard and with ends of light, stiff material.

The invention provides improvements on the construction of a well-known type of furniture, illustrated by FIG. 1. It is made by starting with a sheet of corrugated board (boxboard) which is then twisted 90° at one end.

The resultant structure, whose height is preferably greater than its width, is remarkably strong except for a point of weakness which can occur unpredictably at the central area. Here the creases cross over, and, under load, can crush and weaken one another in such a void-filled material. It is one purpose of the invention to provide means to anticipate and prevent such local weakness, while retaining the light weight and simplicity of such a piece of furniture.

A second purpose of the invention is to provide means to hide entirely within the structure the seam normally visible in a simple folded box, so that the resulting piece of furniture appears entirely seamless and smooth.

Turning now to the construction of a twisted stool from corrugated board, the invention provides, in a first aspect, means for preventing accidental crushing contact.

Figure 4:
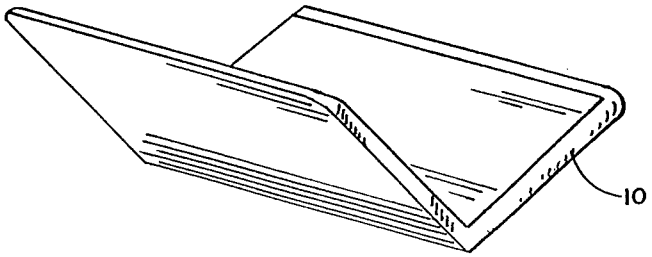
FIG. 4 is a perspective view of a small metal piece used to reinforce the folded and creased stool.
Figure 5:
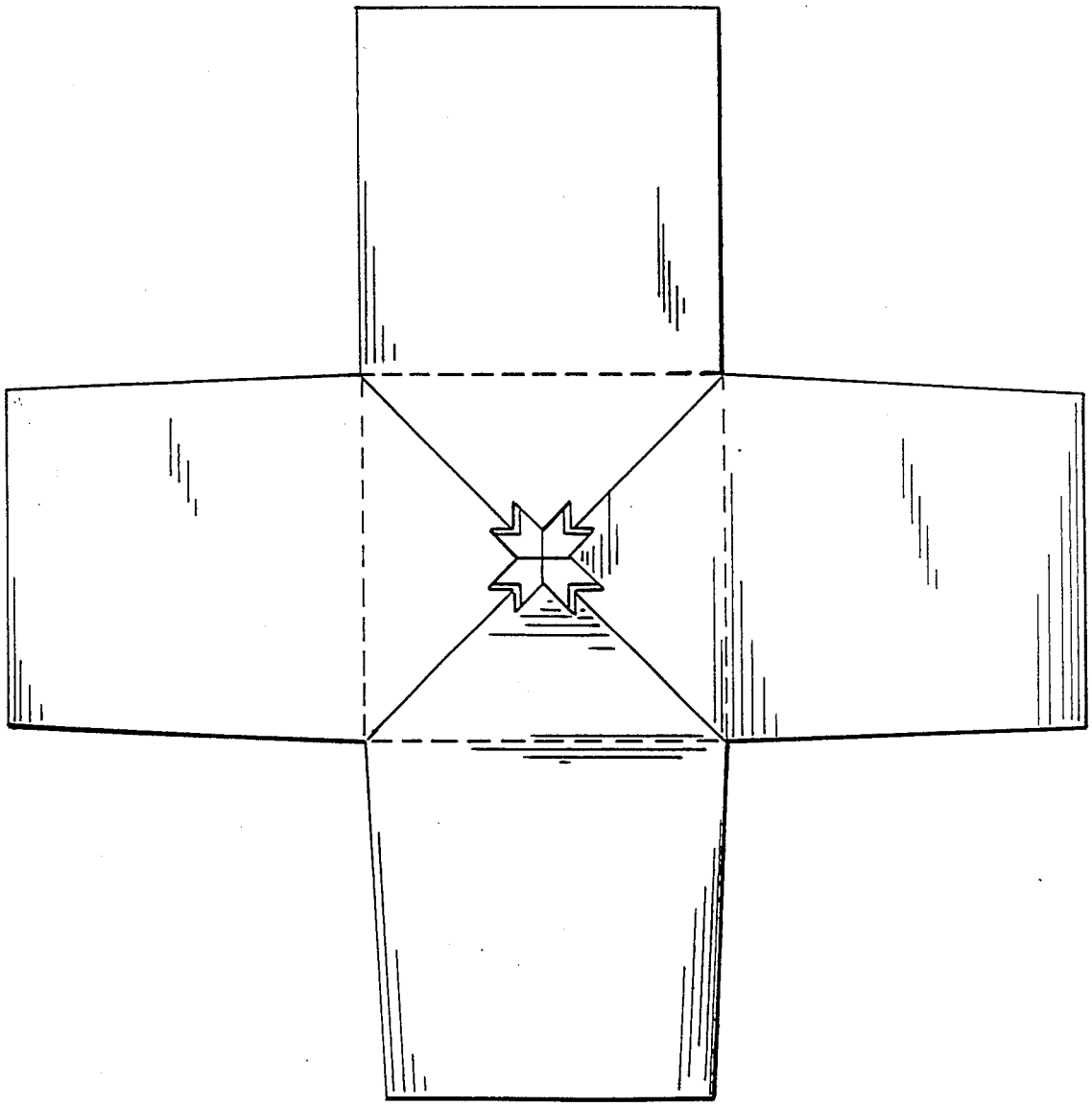
FIG. 5 is a plan view of the stool with flaps open and with metal reinforcements inserted.

FIG. 5 shows the open interior of the stool with end flaps still open. The central cross caused by the twist appears as an inverted pyramid with an apex pointing downward. At this location the sides cross, and under load, can randomly touch and crush the fragile material. To prevent this, according to the invention, four small thin pieces of bent metal, 10 (FIG. 4) are slid in along the natural fold of the sheets. These metal pieces then rest back to back in the meeting of the creases to form a cruciform shape, as shown in FIG. 5. Here they prevent local stresses from reaching the center area to the boxboard sheets. As a result, a small stool of the invention can support a weight of 200 lbs.

Alternatively, the apex area can be reinforced by filling it with a thermosetting polymer, such as epoxy cement. The cement prevents motion of the sides and distributes load, in the same fashion as the bent metal inserts.

Figure 2:
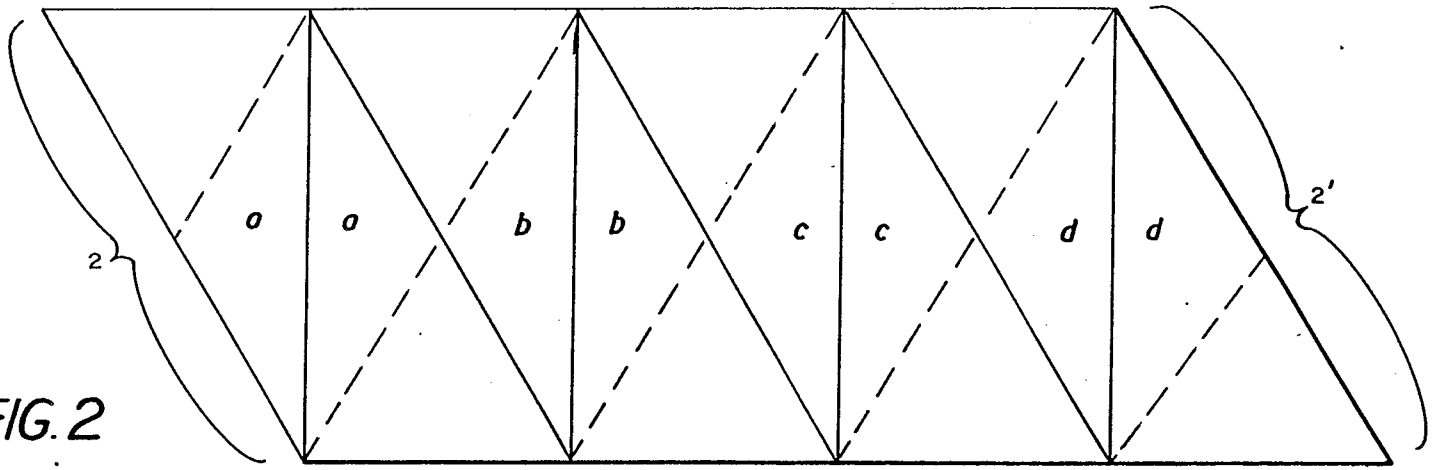
FIG. 2 is a layout view of an unfolded sheet from which said stool is bent, creased, and folded prior to gluing, showing fold lines and areas of gluing according to the invention.

In the furniture of the invention, the main seam is hidden, as mentioned above. The means for achieving this is illustrated in FIG. 2, which shows the flat sheet before folding. The horizontal lines become the top and bottom folds and the vertical lines become the vertical folds of the structure. The diagonals are the additonal creases which are folded inwardly to form the hypotenuses of the twisted stool. The flat sheet of FIG. 2 is folded as shown to form the creases and then 2 and 2' are sealed (e.g., taped), glue is applied as shown, and adjacent facing quadrants are pressed together to form the collapsed box of FIG. 3.

A conventional box, rather than being cut diagonally to form edges 2 and 2', is cut vertically and provided with an outside overlapping flap which is unsightly when folded and glued. In contrast, according to the invention, after the folding and creasing, the diagonally cut ends are lapped along the diagonal half-flaps and glued inside. This becomes the inside of the structure. Hence when the structure is formed, the seam is hidden. This inside seam feature is enhanced because the creases bend inward and retreat from view. Thus a stool or table made according to this teaching of the invention appears seamless and made of continuous material.

A further important feature of the structure is means to make the final twisted configuration easy to make from the packaged, folded precursor, which ordinarily would resist being twisted into the desired final configuration. As shown in FIG. 2, glue is applied in the triangular areas shown and the pairs of adjacent areas are pressed together along the vertical crease lines. This procedure creates a flat figure. If this is grasped internally on opposite sides and pulled apart, it automatically forms the desired twisted figure, and resists, because of the glue, forming non-desired configurations. The facing pairs of triangles which mate with each other when glued are indicated by letter pairs, i.e., triangles a and a are glued to each other, etc. Vertical folds are indicated by solid lines, diagonal folds are solid lines, and lines which define triangular glued areas, but which are not folds, are indicated as dashed lines in FIG. 2.

Figure 3:
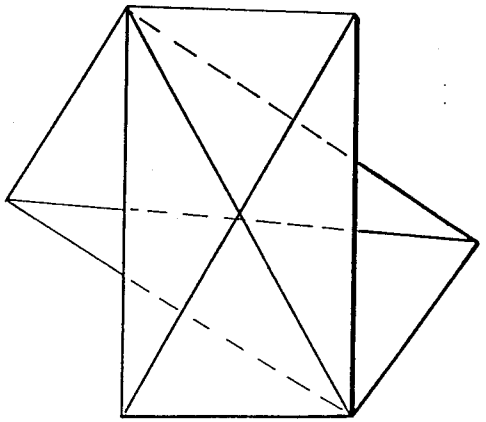
FIG. 3 is a plan view of the sheet of FIG. 2, folded and glued and ready to form a free-standing twisted structure (the end flaps are not shown).

FIG. 3 illustrates the boxboard sheet in collapsed and folded form. There are four panels lying over each other, with back ones hidden and congruent with the ones which are visible. The top and completely visible panel shows two opposing trianges at its top and bottom. Its other two sides are isosceles trianges which are each separate parts of two different pairs of such triangles of double thickness. As previously stated, each of those shown is glued along its long side to the long side of its underlying facing neighbor in this flat configuration.

To create the final three-dimensional twisted stool, a pair of hands or the like are inserted in the so-called opposing triangles, and a rotational twist is applied. This causes the panels to align and thus the triangles on one end twist to become the four sides of an inside pyramid. Simultaneously this happens on the other end, to cause the creased and glued sheet to become the twisted stool.

Other embodiments are within the following claim:

I claim:

1. A flat, collapsed form having eight right triangular regions, six of said regions each being defined by an edge and two intersecting creases, and two of said right triangular regions being defined by two edges and a crease, each said right triangular region including a triangular glued region which shares a side with the facing such triangular, glued region of an adjacent right triangular region, said shared side being a said crease, said facing triangular glued regions being glued together.

* * * * *